US006312341B1

(12) United States Patent
Healy

(10) Patent No.: US 6,312,341 B1
(45) Date of Patent: Nov. 6, 2001

(54) WATER SLIDE WITH CUSHIONING

(76) Inventor: Patrick M. Healy, 322 S. Circle Dr., Wichita, KS (US) 67218

( * ) Notice: Subject to any disclaimer, the term of this patent is extended or adjusted under 35 U.S.C. 154(b) by 0 days.

(21) Appl. No.: 09/525,416

(22) Filed: Mar. 15, 2000

(51) Int. Cl.[7] ..... A63G 21/18
(52) U.S. Cl. ..... 472/117; 472/116
(58) Field of Search ..... 472/116, 117, 472/128, 134; 4/494; 182/48

(56) References Cited

U.S. PATENT DOCUMENTS 2,982,547 * 5/1961 Carrier ..... 472/117
3,363,268 * 1/1968 Friedlander ..... 472/128 X
3,829,353 * 8/1974 Fisher ..... 182/48
4,723,628 * 2/1988 Fisher ..... 182/48
5,669,822 * 9/1997 Smollar et al. ..... 472/117
5,676,602 * 10/1997 Katz et al. ..... 472/117
6,062,983 * 5/2000 Butsook ..... 472/117

* cited by examiner

*Primary Examiner*—Kien T. Nguyen
(74) *Attorney, Agent, or Firm*—Richard K. Thomson

(57) ABSTRACT

A personal water slide has a first series of tubes which cushion the impact of a user launching her/himself onto the extended plastic surface. A second series of tubes each having a diameter at least twice the diameter of the tubes in the first series are positioned along the lateral periphery and help reduce the tendency to slip off the sides of the water slide. An optional third series of tubes permit a hose to be connected thereto and pin hole openings in these tubes form an arched spray which wets the surface of the slide. A flap may extend from each end of the extended plastic surface to permit attachment of two lengths of water slide and attachment of various accessories.

11 Claims, 2 Drawing Sheets

WATER SLIDE WITH CUSHIONING

BACKGROUND AND SUMMARY OF THE INVENTION

The present invention is directed to a personal water slide. More particularly, the present invention is directed to an improved construction of personal water slide which cushions the impact of the user with the ground and helps retain the user on the slide, reducing the likelihood of the user slipping off of the sides.

Personal water slides for use in the backyard to entertain one or more kids have become quite popular. These slides consist of an elongated sheet of plastic which is flooded by a garden hose or the like, to provide a film of water on the sheet which permits a kid to slide along the plastic surface. One problem with these slides is that "bigger kids" who happen to venture to try belly flopping on the slide, find that their larger, and sometimes older, frames do not receive the impact with the ground well.

An additional problem with conventional slides is that more often than not, an approach run for an intended slide along the surface will include a certain component of non-aligned momentum which will lead to the user slipping off the side of the slide. Even if the approach run has an aligned trajectory, a low spot in the terrain supporting the slide can result in repeated slipping off the side of the plastic sheet at the low spot.

A third short coming of existing water slides is that most younger children are forced to watch while their brothers and sisters and older neighbors enjoy the slide. Toddlers lack the ability to perform the necessary motor functions to run and belly flop on the plastic sheet.

It is the intent of the present invention to remedy these deficiencies in the existing water slides. The slide of the present invention comprises an elongated sheet of plastic which includes a built in cushion in the form of a first series of tubes extending along the length of the plastic sheet which can be filled with a first fluid such as air. The valve on the water slide is positioned on the lower surface, for safety reasons, and allows the slide to be inflated by a conventional bicycle pump, a compressor, or orally. This first series of tubes preferably have a diameter, for example, of between 1 and 3 inches.

A second series of tubes having a larger diameter adjacent the periphery of the slide provide a side deflecting cushion which help keep the user from sliding off the side of the plastic sheet. These tubes preferably have a diameter, for example, of between 2 and 5 inches and will preferably have larger diameter than the tubes of the first series, on the order of double the diameter.

The water slide of the present invention includes a rectangular skimmer seat which is dimensioned to fit within the second series of tubes and which is equipped with a tow rope. Younger siblings can then be included in the fun by permitting a parent or older, responsible child to pull the toddler seated on the skimmer along the surface of the water slide.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 2:
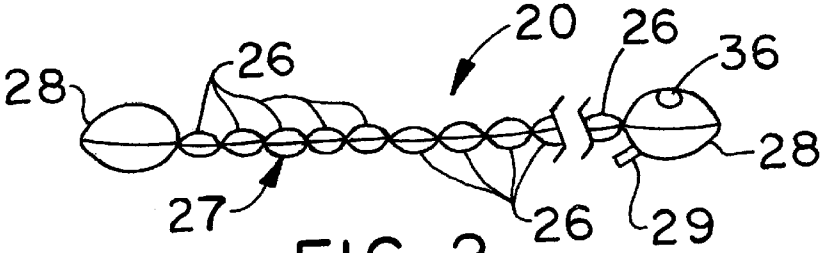
FIG. 2 is an end view of the first embodiment.
Figure 1:
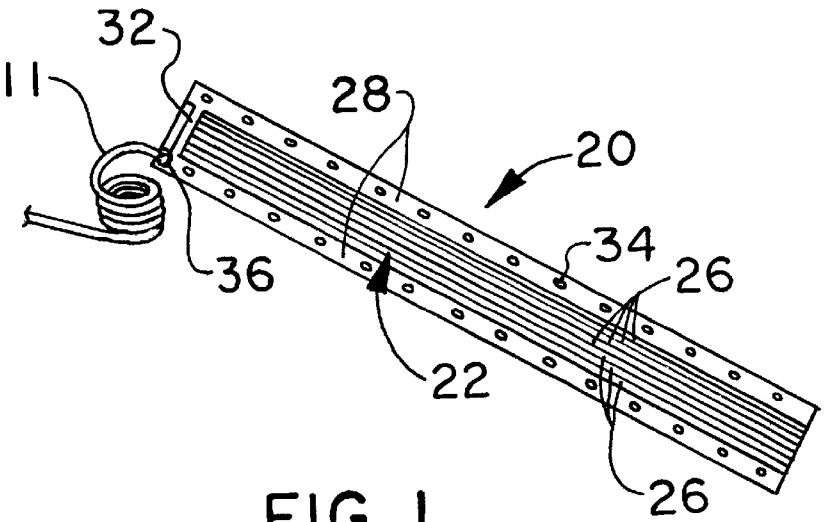
FIG. 1 is a perspective view of a first embodiment of the water slide of the present invention.

A first embodiment of water slide of the present invention is depicted in FIGS. 1 and 2 generally at 20. Water slide 20 comprises an elongated or extended plastic surface 22. The upper portions 24 of a first series of tubes 26 make up the bulk of extended plastic surface 22. First series 26 of tubes may comprise any number desired of tubes which preferably have a diameter, for example, in the range between 1" and 3". The second series 28 of tubes are positioned near the lateral periphery of surface 22 and define the lateral boundaries thereof and, in some embodiments, will form the balance of extended surface 22. Each of the tubes of series 28 preferably has a diameter in the range of between 2" and 5" but, in any event, each of the tubes in series 28 is preferably at least twice the diameter of each of the tubes in first series 26. The purpose of second series 28 is to reduce the likelihood that the user will slip off the side of extended plastic surface 22 and these tubes need twice the diameter (four times the volume) to provide a sufficient barrier to prevent side slip. Although series 28 is depicted as only one tube is shown on each lateral boundary, it is within the scope of the present invention to have two or more tubes in series 28 along each boundary. A valve 29 (FIG. 2) enables first series 26 and second series 28 of tubes to be filled with a first fluid such as air. First (26) and second (28) series of tubes may be pumped up using a bicycle pump, a compressor or blown up orally. Valve 29 is preferably on the under surface 27 of water slide 20 to avoid injury to a user who hops onto surface 22 and might otherwise land on valve 29.

Figure 3:
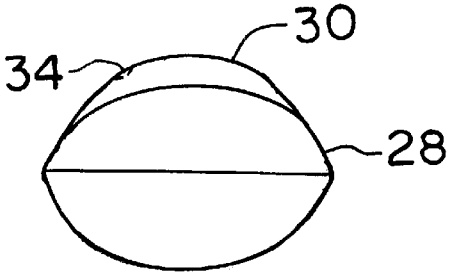
FIG. 3 is an enlarged cross-sectional end view of a lateral tube of the first embodiment.

A coating or film of water will be created on the surface 22 using a garden hose 11 as is customary with personal water slides. Water slide 20 may be optionally equipped with a third series 30 of tubes which lie along the tops of portions of the second series 28. In embodiments including tubes 30, they form the balance of surface 22 not formed by the upper surfaces 24 of first series of tubes 22. Tubes 30 are interconnected by a transverse flow passage 32 and tubes 30 have pin hole openings 34 formed at spaced intervals along their lengths to squirt water streams over surface 22. A threaded connector 36 may be provided to permit hose 11 to input water to tubes 30 and out through pin hole openings 34 (FIG. 3) to form over arching streams which wet the surface 22.

Figure 4:
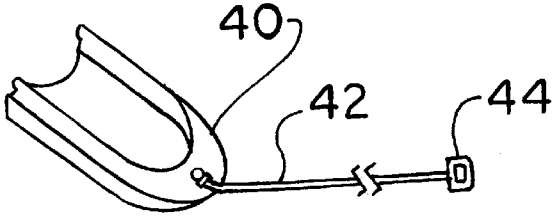
FIG. 4 is a perspective view of a towable sled usable with the water slide.

Typically, toddlers will be excluded from enjoying most water slides. However, water slide 20 of the present invention includes a generally rigid plastic skimmer or sled 40 (FIG. 4) upon which a toddler may sit and an adult or older child may pull the toddler along surface using tow rope 42 which is equipped with handle 44. Sled 40 is dimensioned to fit between the lateral boundary forming second series 28 of tubes.

Figure 5B:
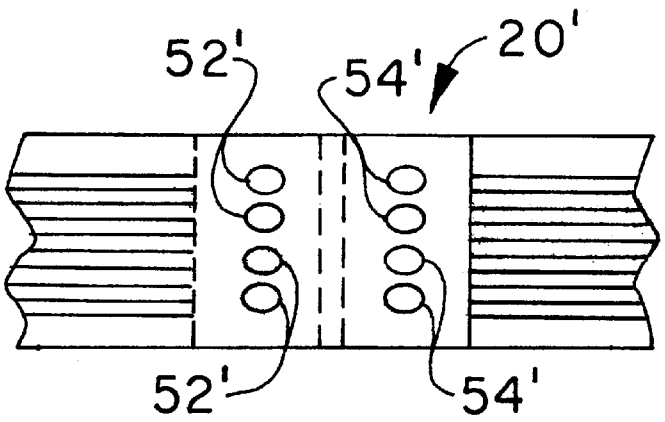
FIG. 5B is a bottom view of the second embodiment shown in FIG. 5A.
Figure 5C:
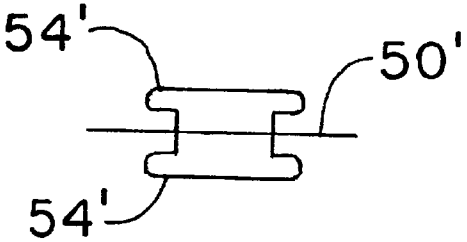
FIG. 5C is an enlargement of the protrusions used in this second embodiment.
Figure 5A:
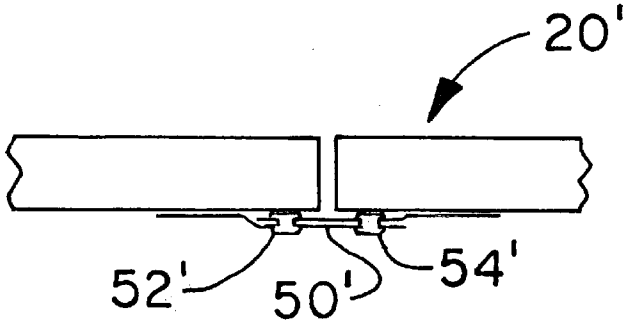
FIG. 5A is a side view of a second embodiment of the present invention.

A second embodiment of the water slide of the present invention is shown in FIGS. 5A, 5B and 5C generally at 20'. This embodiment is equipped with an additional feature. A flap 50' extends from each end of the water slide 20'. Flap 50' has a row of holes 52' and a row of complementary protrusions 54'. Protrusions 54' extend both above and below the surface of flap 50' so both flaps 50' may occupy the top or bottom position when protrusions 54' of one flap are pushed through holes 52' of the other. This enables two sections of water slide 20' to be linked together to extend its overall run. In addition, holes 52' and protrusions 54' could be used to attach other accessories such as a small wading pool or a fan shaped piece of plastic which could be used to disperse the runoff over a wider area reducing wear and tear on the yard.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A personal water slide comprising a) an extended plastic surface;

b) a first series of tubes having a first diameter for receiving a first fluid and supporting said extended plastic surface and a weight of a user;

c) a second series of tubes formed along each lateral outer edge of said extended plastic surface having a second larger diameter for receiving the first fluid and delimiting an outer lateral boundary of said extended plastic surface;

d) means to coat said extended plastic surface with a layer of a second fluid;

whereby said first series of tubes will cushion an impact resulting from the user diving onto said extended plastic surface and said second series of tubes will reduce the probability that the user will slide off the sides of said extended plastic surface.

2. The personal water slide of claim 1 wherein said first fluid comprises air which at least partially fills said first and second series of tubes.

3. The personal water slide of claim 1 wherein said means to coat further comprises a garden hose directing a water stream onto said extended plastic surface.

4. The personal water slide of claim 1 wherein said means to coat further comprises a) a third series of tubes for receiving a second fluid;

b) a plurality of outlets for receiving said second fluid and spraying said second fluid on said extended plastic surface to provide a fluid film upon which the user may slide;

c) means to attach a garden hose to said third series of tubes.

5. The personal water slide of claim 1 further comprising a generally rectangular plastic member which fits within said second series of tubes and is capable of supporting the weight of a user.

6. The personal water slide of claim 5 wherein said generally rectangular plastic member is fitted with a tow rope to enable a parent or older child to pull a small tot on said plastic member along said extended plastic surface.

7. The personal water slide of claim 1 wherein each tube of said first series of tubes preferably has a diameter in the range of between 1 inch and 2.5 inches.

8. The personal water slide of claim 7 wherein each tube of said second series of tubes preferably has a diameter of between 2 inches and 5 inches.

9. The personal water slide of claim 7 wherein said diameter of each tube of said second series of tubes is at least twice the diameter of each said tube of said first series of tubes.

10. The personal water slide of claim 1 further comprising a flap extending from at least one end of said extended plastic surface, said flap having a laterally extending row of holes and a complementarily shaped laterally extending row of protrusions enabling two of said extended plastic surfaces to be attached.

11. The personal water slide of claim 10 wherein one of said flaps extends from each end of said extended plastic surfaces.

* * * * *